United States Patent [19]

Hunt et al.

[11] Patent Number: 4,646,048

[45] Date of Patent: Feb. 24, 1987

[54] CORE AND WINDING ASSEMBLY WITH RELIEVED CORE EDGES AND METHOD OF MANUFACTURE THEREOF

[75] Inventors: Robert H. Hunt, Newton; Willi Klappert, Hickory, both of N.C.

[73] Assignee: General Electric Company, King of Prussia, Pa.

[21] Appl. No.: 728,435

[22] Filed: Apr. 29, 1985

[51] Int. Cl.[4] ..... H01F 27/24

[52] U.S. Cl. ..... 336/213; 336/221; 336/212

[58] Field of Search ..... 336/212, 213, 221, 233, 336/234

[56] References Cited

U.S. PATENT DOCUMENTS

| | | | |
|---|---|---|---|
| 1,105,014 | 7/1914 | Austin | 336/234 |
| 1,425,091 | 8/1922 | Horelick | 336/234 X |
| 1,644,729 | 10/1927 | Johannesen | 336/234 |
| 2,314,912 | 3/1943 | Troy | 336/234 |
| 2,907,966 | 10/1959 | Dierstein | 336/221 |
| 3,137,832 | 6/1964 | Hurt, Jr. et al. | 336/234 |
| 3,307,132 | 2/1967 | Ellis | 336/213 |
| 3,309,641 | 3/1967 | Burkhardt et al. | 336/213 |
| 3,451,130 | 6/1969 | Ellis | 336/227 |
| 4,007,541 | 2/1977 | Monforte et al. | 336/233 |
| 4,494,102 | 1/1985 | Fisher et al. | 336/212 |

*Primary Examiner*—Arthur T. Grimley
*Assistant Examiner*—C. Romano
*Attorney, Agent, or Firm*—William Freedman; Henry J. Policinski

[57] ABSTRACT

To reduce the material in a transformer core and winding assembly, the edges of the core winding legs are relieved so as to achieve improved conformity with the inside corners of the coils disposed thereabout. More intimate spacing of the coils relative to the legs is therefore accommodated with consequent material savings in both the core and the winding coils. Methods for relieving the leg edges by bevelling and notching are disclosed.

7 Claims, 10 Drawing Figures

CORE AND WINDING ASSEMBLY WITH RELIEVED CORE EDGES AND METHOD OF MANUFACTURE THEREOF

BACKGROUND OF THE INVENTION

The present invention relates to transformers and particularly to a cost improved core and winding assembly for mass-produced distribution-type transformers and a method of manufacturing same.

The manufacture of smaller, high volume electrical transformers is an involved process requiring a heavy capital investment. Moreover, this business is extremely competitive, and thus any manufacturing cost advantage over competition can be a significant commercial advantage in the marketplace. Even a small savings in labor content, material costs or material savings in each transformer, due to the high volume involved, can amount to significant manufacturing cost savings.

It is accordingly an object of the present invention to provided a cost-improved transformer core and winding assembly.

An additional object is to provide a transformer core and winding assembly of the above-character, wherein the quantity of material required to fabricate the core is reduced.

A further object is to provide a transformer core and winding assembly of the above-character wherein the quantity of material required to fabricate the winding coil is reduced.

Yet another object is to provide a transformer core and winding assembly of the above-character, where material savings in the fabrication of both the core and the winding coil are achieved without sacrificing transformer performance.

A further object is to provide a core and winding assembly of the above-character which, incident to the achieved material savings, has enhanced ability to withstand the forces associated with the flow of high fault currents through the winding coil.

Still another object of the present invention is to provide a method for manufacturing a transformer core and winding assembly of the above-character.

Other objects of the invention will in part be obvious and in part appear hereinafter.

SUMMARY OF THE INVENTION

In accordance with the present invention, there is provided a transformer core and winding assembly having a core of reduced size and one or more coils disposed thereon of reduced mean turn length, thus affording savings in the materials required to fabricate both the core and the coil or coils. These material savings are achieved in a simple and expeditous manner by relieving the edges of the core winding legs about which the coils are disposed. The relieved configuration of the leg edges is such as to conform with the inside corners of the coils, thus accommodating a more intimate spatial relationship between the coils and the core legs than is possible when the core legs are left with essentially right angle edges as has heretofore been the practice. As a consequence of the present invention, the dimension of the core window between the winding legs can be reduced, and the core can be made of a correspondingly smaller size. Consequently, less material is required to fabricate the core. Moreover, by virtue of the reduced spacing achieved between the inner surfaces of the coils and the surfaces of the winding legs, the mean conductor turn length of the coils is reduced with a consequent savings in coil material.

In accordance with one embodiment of the invention, the winding leg edges are bevelled, while in another embodiment they are notched. Pursuant to the method aspects of the invention by which the core leg edges are relieved such as by bevelling or notching, the core laminations are arranged as superimposed turns to form an annular structure which can be readily turned about its axis to facilitate machining to relieve the annular edges of the structure. The structure is then shaped into a rectangular core having opposed winding leges and interconnecting yokes circumscribing a core window. The core is opened to accommodate disposal of the preformed coils in intimately spaced relation about the winding legs and then closed to complete the core and winding assembly.

The invention accordingly comprises the features of construction, combination of elements, arrangement of parts and series of method steps which will be exemplified in the description hereinafter set forth, and the scope of the invention will be indicated in the claims.

DESCRIPTION OF THE DRAWINGS

For a fuller understanding of the nature and object of the invention, reference should be had to the following detailed description taken in conjunction with the accompanying drawings in which.

Corresponding reference numerals refer to like parts throughout the several views of the drawings.

DETAILED DESCRIPTION

Figure 1:
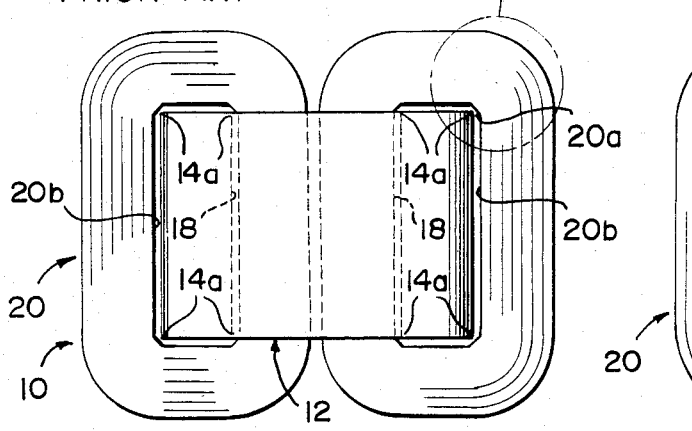
FIG. 1 PRIOR ART
FIG. 1 is a plan view of a prior art core and winding assembly.
Figure 2:
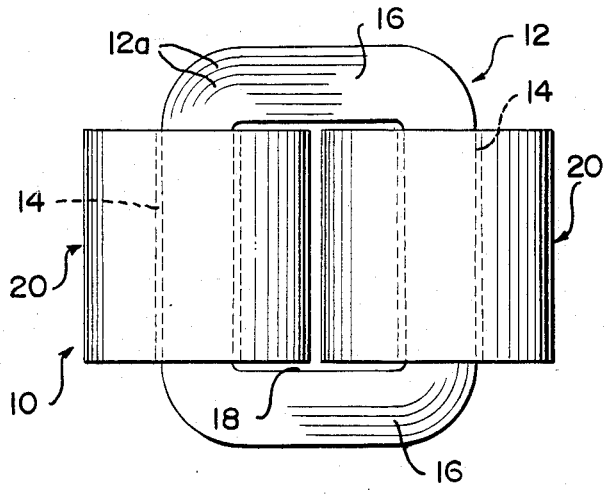
FIG. 2 PRIOR ART
FIG. 2 is a side view of the core and winding assembly of FIG. 1.
Figure 3:
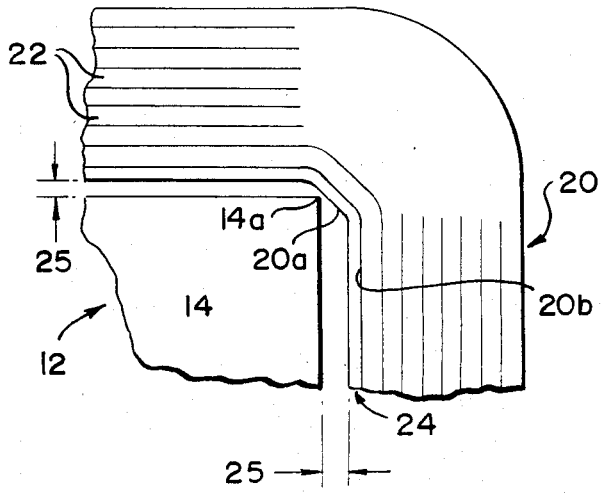
FIG.3 PRIOR ART
FIG. 3 is an enlarged sectional view of one corner portion of the prior art core and winding assembly of FIG. 1.

FIGS. 1 and 2 illustrate a core and winding assembly 10 constructed in accordance with the prior art to include a generally rectangular core 12 having a pair of winding legs 14 interconnected by upper and lower yokes 16 circumscribing a core window 18. As is conventional practice, the core is made by winding a strip of magnetic material, such as silicon steel, into an annular form comprised of plural, superimposed turns of magnetic laminations 12*a*. The annular form is then pressed into the generally rectangular core shape illustrated in FIG. 2. Disposed about each winding leg is a coil 20 comprised of multiple turns of individually insulated conductors 22 tightly bundled together with an insulative layer 24 interposed between the coil and the leg, as illustrated in the fragmentary enlargement of FIG. 3. As illustrated in FIG. 1, each coil 20 is of a generally rectangular shape and has a generally rectangular opening **20*b* for receiving a winding leg 14 of the core. Each winding leg has a rectangular cross-section, and thus presents edges of a relatively sharp, right angle configuration, as seen in FIGS. 1 and 3 at 14*a*. It is found that the heavy bundle of conductors 22 making up each coil 20 can not be bent at such a sharp angle to go around these winding leg edges. Rather, the inner corners of the coils, indicated at 20*a* in FIG. 3, are curved or in the form of two 45° bends in order to negotiate the 90° turn about the core leg edges 14*a*. It is thus readily seen that the core leg edges and the coil inner corners conform very poorly to each other. Efforts to improve this corner conformance have concentrated on making the coil corners conform more closely to the winding leg edges, but have been largely unsuccessful. As a consequence of this poor conformance, considerable spacing or clearance 25 is imposed between the winding legs and the rectangular openings 20*b*** of the coils disposed thereabout. This clearance, which is also required for ease of assembly, can be as large as, for example, 0.145 inches on each of the four sides of the core leg. It will be appreciated that this clearance requires a corresponding increase in the coil mean length of conductor turn, as well as a wider core window, and thus a larger core, to accommodate the coils.

Figure 4:
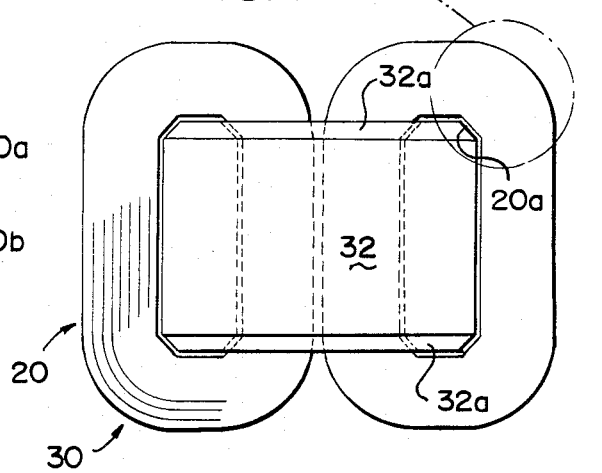
FIG. 4 is a plan view of a core and winding assembly constructed in accordance with one embodiment of the invention.
Figure 5:
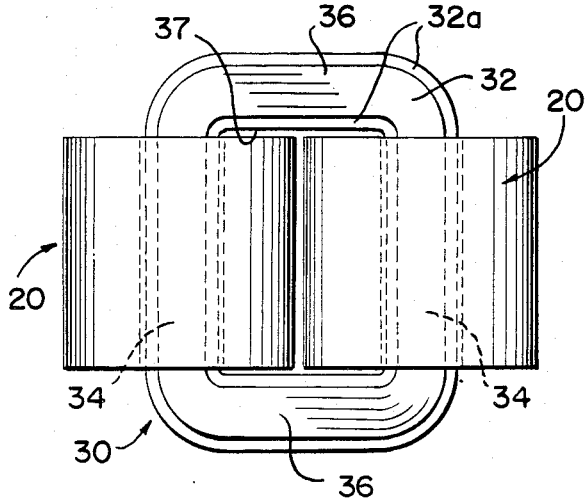
FIG. 5 is a side view of the core and winding assembly of FIG. 4.
Figure 6:
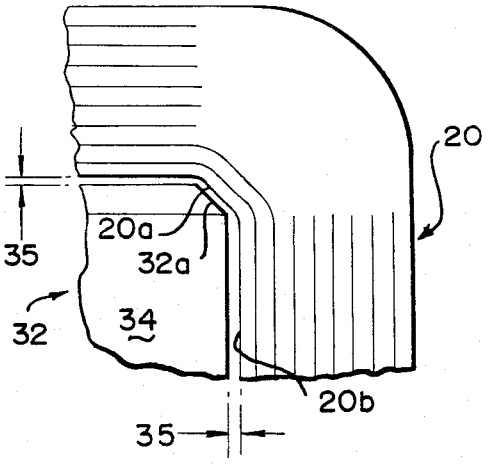
FIG. 6 is an enlarged, sectional view of one corner portion of the core and winding assembly of FIG. 4.

In accordance with one embodiment of the present invention, a core and winding assembly 30 of FIGS. 4 and 5 includes a generally rectangular core 32 having opposed, essentially straight winding legs 34 and interconnecting yokes 36 creating a closed magnetic circuit and defining a core window 37. Each winding leg has an inner surface bounding the core window, an outer surface parallel thereto and two lateral surfaces transverse to the inner and outer surfaces to provide an essentially rectangular winding leg cross-section; the planes of the lateral surfaces intersecting the planes of the inner and outer surfaces at pairs of inner and outer edge regions which, in accordance with the present invention, are corner-relieved. In the embodiment shown in FIGS. 4 and 5, these edge regions are bevelled, as indicated at **32*a* and a best seen in FIG. 6. It is readily seen that these bevelled edges of the core winding legs 34 conform quite well to the inner corners 20*a* of coil 20 disposed thereabout. As a consequence, the clearance 35 between the rectangular coil openings 20*b*** and the core legs can be reduced dramatically, down to as low as 0.05 inches for example, and still accomodate ease of assembly. The coil mean length of turn is thus reduced and the width of the core window may also be reduced, thus affording material savings in both the coil and the core. These material savings are achieved without sacrificing performance. As an incidental benefit, since the coils fit more intimately about the core legs, their ability to withstand high short circuit forces is enhanced. While it is the edge relieving of the winding legs that affords the benefits of the present invention, from a manufacturing standpoint, it is desirable to also edge-relieve the yokes, as will become apparent below.

Figure 7:
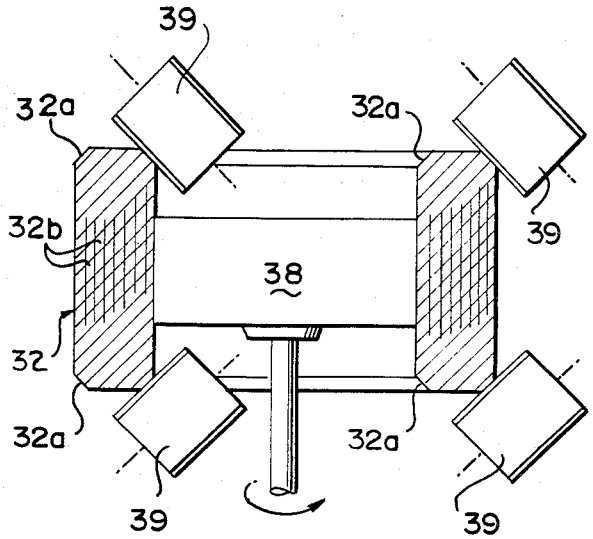
FIG. 7 is a diagrammatic sectional view of a machining process for bevelling the edges of a core pursuant to an embodiment of the present invention.

To create the bevelled edges **32*a* on core 32 in accordance with the present invention, multiple turns of superimposed laminations 32*b* are wound to form an annular structure which is mounted on an expandable mandrel 38 for rotation about its axis, as seen in FIG. 7. Four grinders 39 are positioned to machine bevels 32*a* in the two inner and two outer right angle edges of the annular structure. Once the desired edge bevelling has been achieved, the annular strucure is removed from the mandrel and, using suitable dies (not shown), is pressed into the rectangular core shape seen in FIG. 5. The core 32 is stress annealed, opened to accommodate mounting of coils 20 on core legs 34, and closed to complete the core and winding assembly 30** of the invention.

Figure 8:
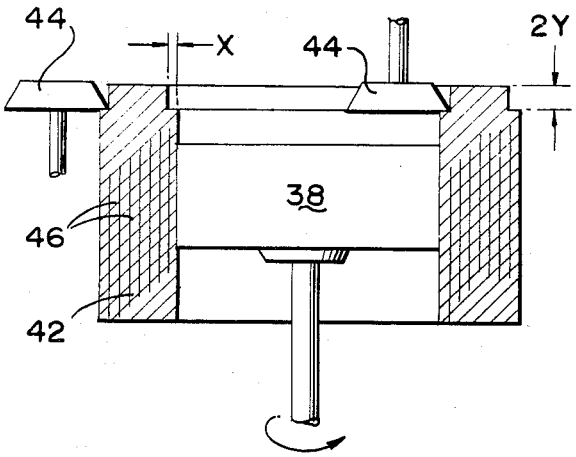
FIG. 8 is a diagrammatic sectional view of a machining process for notching the edges of a core pursuant to an alternative embodiment of the invention.
Figure 9:
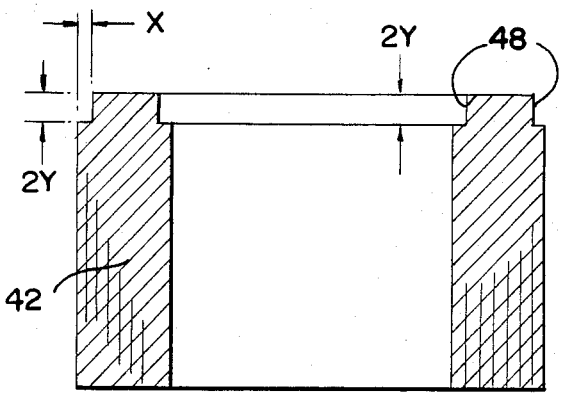
FIG. 9 is a sectional view of the core of FIG. 8 after machining.
Figure 10:
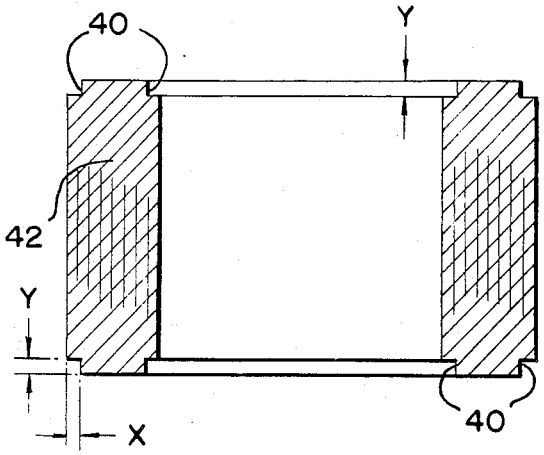
FIG. 10 is a sectional view of the core of FIG. 9 after the machined core laminations have been rearranged to create notches in all four edges of the core.

As an alternative embodiment of the invention, the inner and outer pairs of edges of the core are relieved by forming notches 40 therein as illustrated in FIG. 10, rather than bevels. To create these notches, the core is again initially formed as an annular structure 42 and turned on a mandrel 36, as seen in FIG. 8. Slitters 44 are positioned to cut off a single marginal strip from each of a predetermined equal number of innermost and outermost laminations 46 making up the annular structure 42. The number of laminations so cut is determined by the radial or transverse depth, indicated at x in FIGS. 8–10, desired for the notches 40. On the other hand, the width of the removed marginal strips, indicated at 2y in FIGS. 8 and 9, is equal to twice the desired axial or longitudinal depth y (FIG. 10) of notches 40. In practice the dimensions x and y will typically be equal.

FIG. 9 illustrates the annular structure 42 after the slitting operation of FIG. 8 with oversized notches 48 formed in a radically aligned pair of inner and outer edges thereof. To create the notches 40 in all four edges as seen in FIG. 10, the innermost and outermost laminations that were slit in the operation of FIG. 8 are simply shifted axially upwardly, in the illustrated orientration, by a distance y. The axial depth of the upper edge notches 48 in FIG. 9 are reduced to the dimension y, and, at the same time, notches of axial depth y are created in the lower edges. Since only the slit laminations are shifted in position, the radial dimensions of all notches 40 are equal to y. The annular structure 42 of FIG. 10 is then shaped into the rectangular core configuration corresponding to core 32 of FIG. 5, stress annealed, and fitted with coils in the manner generally described above.

Notching, rather than bevelling, the core edges may in some instances achieve better conformity with the coil inner corners if, in the process of bending the coil to make the ninety degree transition, coil material at these inner corners bulges or puckers outwardly. Compared with the grinding operation of FIG. 7 to create the bevelled core edges, the slitting operation of FIG. 8 pursuant to notching the core edges is cleaner and faster, particularly since the marginal strips are cut from only one end of the core. The principal drawback of notching the core edges is that it requires removal of more core material than may be necessary to achieve conformity between the core edges and the inner corners of the coil.

It will be appreciated that a reasonable facsimile of the illustrated bevelled core edges can be achieved by slitting successively narrower marginal strips from the innermost and outermost laminations of the core along all four edges or just two radically aligned edges followed by shifting the postions of the slit laminations to produce similar bevels along all four edges. Similarly, the grinding operation of FIG. 7 could be performed on two edges at a steeper angle than illustrated herein, and the innermost and outermost laminations shifted in position to create relieved core edges resembling bevels along all four edges. Moreover, the reliefs machined into the core leg edges may be such as to produce rounded or arcuate edges.

It will thus be seen that the objects of the invention set forth above and made apparent from the foregoing description are efficiently attained and, since certain changes may be made therein without departing from the scope of the invention, it is intended that all matter contained in the above description or shown in the accompanying drawings shall be interpreted as illustrative and not in a limiting sense.

Having described the invention, what is claimed as new and desired to secure by Letters Patent is:

1. A transformer core and winding assembly comprising:

A. a generally rectangular magnetic core including a pair of opposed, essentially straight winding legs of generally rectangular cross-section interconnected by a pair of opposed yokes to provide a closed magnetic circuit and to define a core window, each winding leg having an inner surface bordering said core window, an outer surface generally parallel to said inner surface, and two lateral surfaces disposed transversely of said inner surface; said inner surface being generally disposed in a first plane, said outer surface in a second plane, and said lateral surfaces in third and fourth planes that intersect said first plan in a pair of inner edge regions and intersect said second plane in a pair of outer edge regions, at least one of said winding legs being corner-relieved in said two inner edge regions and in said two outer edge regions; and B. a coil having a generally rectangular opening corresponding in cross-sectional shape to the cross-sectional shape of said one winding leg, said coil being disposed about said one leg with the corners of said coil opening accommodated in intimate, essentially conforming relationship with said one winding leg at said corner-relieved edge regions.

2. The transformer core and winding assembly defined in claim 1, wherein said pairs of inner and outer edge regions of said one leg are bevelled.

3. The transformer core and winding assembly defined in claim 1, wherein said pairs of inner and outer edge regions of said one leg are notched.

4. The transformer core and winding assembly defined in claim 1, wherein said pairs of inner and outer edge regions of both said legs are corner-relieved, and a coil disposed about each of said legs with the corners of said coil openings being accommodated in intimate, essentially conforming relation with said pairs of relieved inner and outer edge regions of its associated one of said legs.

5. The transformer core and winding assembly defined in claim 4, wherein said pairs of inner and outer edge regions of both said legs are bevelled.

6. The transformer core and winding assembly defined in claim 4, wherein said pairs of inner and outer edge regions of both said legs are notched.

7. The transformer core and winding assembly defined in claim 4, wherein said core is a wound core consisting of a plurality of superimposed turns of magnetic laminations.

* * * * *